United States Patent [19]

Kramer

[11] Patent Number: 4,700,865

[45] Date of Patent: Oct. 20, 1987

[54] TEAR-OPEN CAN MEMBER

[75] Inventor: Felix Kramer, Friedlisberg, Switzerland

[73] Assignee: Elpatronic AG, Switzerland

[21] Appl. No.: 934,692

[22] Filed: Nov. 25, 1986

[30] Foreign Application Priority Data

Jan. 10, 1986 [CH] Switzerland ..... 00078/86

[51] Int. Cl.[4] ..... B65D 17/36

[52] U.S. Cl. ..... 220/274; 220/276

[58] Field of Search ..... 220/274, 275, 276

[56] References Cited

U.S. PATENT DOCUMENTS 2,806,628 9/1957 Morrill et al. ..... 220/274

3,838,787 10/1974 McCloskey ..... 220/274

4,637,521 1/1987 Opprecht et al. ..... 220/276

*Primary Examiner*—George T. Hall

[57] ABSTRACT

The can member (10) is provided with a pair of scorings (16) which define a tear-off strip (18) laterally. A tongue (20) produced as a separate sheet-metal member is welded onto the tear-off strip (18) in a welding region (42) at one of its ends. Between the welding region (42) and the free end (32) of the tongue (20), a starting scoring (30) extends over the tear-off strip (18). The starting scoring (30) extends substantially transversely to the lateral scorings (16) only in a central region of the tear-off strip (18) and extends away from the free end (32) of the tongue (20) in the vicinity of the two lateral scorings (16). The welding region (42) covers the starting scoring (30) in the vicinity of each of the two lateral scorings (16). As a result, care is taken to ensure that a tearing open operation can be reliably initiated by rolling up the tongue, substantially regardless of inaccuracies in manufacture.

7 Claims, 8 Drawing Figures

TEAR-OPEN CAN MEMBER

The invention relates to a tear-open can member of sheet-metal having a pair of scorings which define a tear-off strip laterally, a tongue which is welded, as a separate sheet-metal member, to the tear-off strip, at one of its ends, in a welding region which extends at least substantially over the whole width of the tear-off strip, and a starting scoring which extends over the tear-off strip between the welding region and the free end of the tongue.

In the case of a known can member (DE-C 1 017 042), the tongue is punched out in one piece together with a sheet-metal blank which is plane in the initial state, and extends, in this plane, beyond one of two longitudinal edges of the sheet-metal blank. Together with the two scorings which define the tear-off strip laterally, a starting scoring, which connects these scorings to one another, is stamped in the sheet-metal blank close to the other longitudinal edge. The sheet-metal blank is then rolled up in such a manner that the two longitudinal edges overlap one another and these are subsequently welded together to form a longitudinal seam so that a cylindrical can body results. A complete can is finally produced from this in that the two ends of the can body are closed by beading to a cover and a bottom respectively. In order to tear the can open, a key is placed on the tongue and is rolled on the nearest beaded edge.

With these known cans, inexperienced users in particular do not always succeed in removing the tear-off strip completely in the desired manner at the first attempt. Not infrequently, the tear-off strip tears off already in the region of the longitudinal edges or shortly after them because converging cracks, starting from the tongue, form and are situated between the lateral scorings. The user is then forced to continue the opening of the can with a tool which is not provided for this purpose and there is a danger that he may injure himself on sharp sheet-metal edges.

With the intention of making the tearing open operation more reliable, a tear-open can member of the type described at the beginning has been proposed, for example in DE-OS 35 16 388, wherein the starting scoring is formed by a scoring line which extends transversely over the tear-off strip and possibly reaches a short distance over each of the two scorings defining the tear-off strip laterally.

Can members in accordance with this earlier proposal, which is not a prior publication, can be torn open satisfactorily if the tongue has successfully been arranged accurately on the tear-off strip when it is welded on, in such a manner that the starting scoring is situated immediately beside the welding region. If, however, as a result of manufacturing inaccuracies, the welding region is either too far away from the starting scoring or overlaps this, the starting scoring cannot perform its task or can only do so imperfectly, of allowing the tear-off strip first to bend, when the tongue is rolled up by means of a key, and then to tear more or less quickly over the whole width between the scorings defining it laterally. Inaccuracies in manufacture, which may lead to an unfavourable position of starting scoring and welding region in relation to one another, thus making the tearing open operation more difficult, result from the tolerances during the impressing of the starting scoring, during the punching and handling of the tongue and during the welding itself. If all these tolerances are to be kept so small that they do not have a disadvantageous effect on the tearing open operation even in the event of unfavourable combination, this requires comparatively expensive methods and equipment to carry out the said procedures.

It is therefore the object of the invention to develop further a tear-open can member of the type described at the beginning, in such a manner that the tearing open operation is not made appreciably more difficult even by comparatively great manufacturing inaccuracies of the type described.

According to the invention, the problem is solved in that the starting scoring extends substantially transversely to the lateral scorings only in a central region of the tear-off strip and extends away from the free end of the tongue in the vicinity of the two lateral scorings, and that the welding region overlaps the starting scoring in the vicinity of the two lateral scorings.

The lengths of the portion of the starting scoring extending substantially transversely and of the two portions extending substantially longitudinally as well as the distance of its portion extending transversely from the welding region can be adapted, as a result of simple experiments, to the thickness of the sheet-metal and the other characteristics of the can member and of the tongue, and be made dependent on the working accuracy of the manufacturing devices available, in such a manner that even in the event of the most unfavourable combination of all the tolerances, the welding region is sure to overlap the two portions of the starting scoring extending longitudinally, the welding region intersecting these portions extending longitudinally. The portion of the starting scoring situated between the overlapping regions allows the tear-off strip to yield articulately and then start to tear when the tongue is rolled up with a key.

It is an advantage if the starting scoring has the shape of a convex arc extending transversely to the free end of the tongue, over two thirds to four fifths of the width of the tear-off strip.

In this case, following on the arc at both sides, the starting scoring can extend substantially parallel to the lateral scorings.

The starting scoring may be closed on itself in the form of a circle or oval or in the form of a trapezoid following on the arc at both sides.

Such starting scorings can be produced with a press die which is loaded axially symmetrically during the impressing and can therefore be guided particularly accurately and almost without wear. Above all, however, scorings closed on themselves have the advantage that they have particularly little tendency to break open and so make the can member unusable if this is exposed to bending loads and/or tensile loads. Bending loads occur, for example, if the can member in the form of a plane sheet-metal blank is rolled up to form a cylindrical can body. In addition, increased bending loads can occur if a filled can is deformed by careless handling. Expansion loads, which can be critical in the region of the starting scoring, occur particularly when a can member which is first rolled up cylindrically is widened to form a parallelepiped body or one in the form of a truncated pyramid or cone.

A further alternative consists in that the field comprises a plurality of diagonal scorings crossing one another.

According to the design as described in DE-OS 35 15 833, the tongue of a tear-open can member has a thickened portion in the shape of an arrow directed towards the free end of the tongue at its welded-on end. In combination with such a formation of the tongue, the present invention can be developed further in a particularly advantageous manner in that the front end of the arrow-shaped thickened portion or prominent portion is set back by about two or three times the thickness of the sheet-metal of the can member in relation to the starting scoring.

Examples of embodiment of the invention are explained below, with further details, with reference to diagrammatic drawings.

Figure 1:
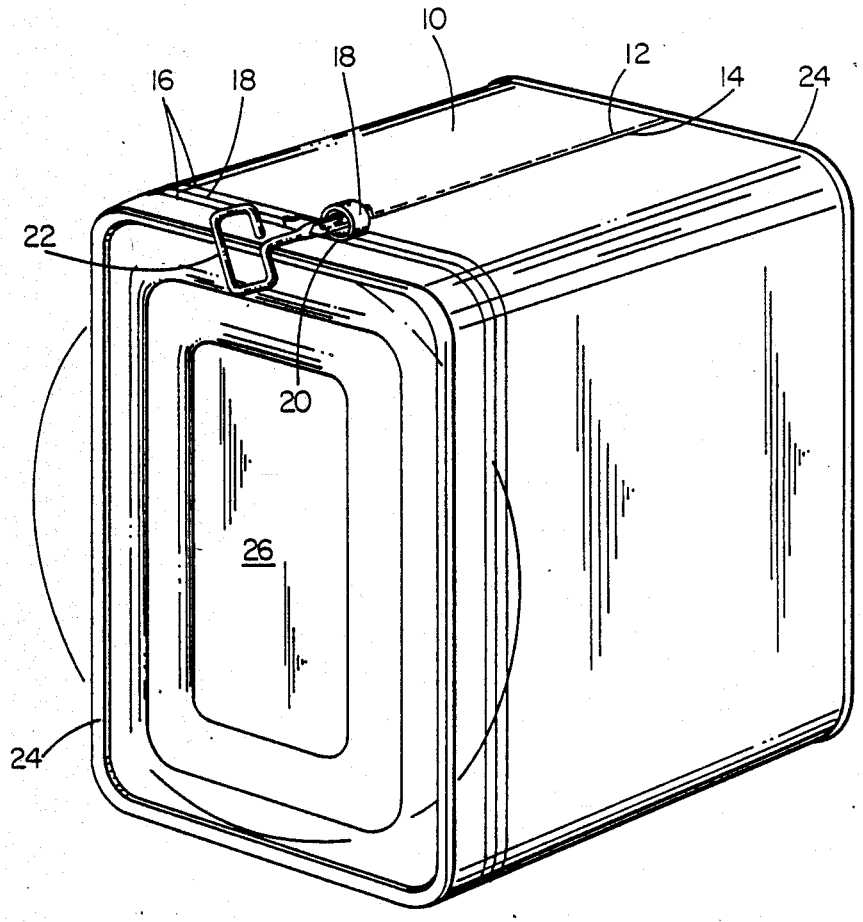
FIG. 1 shows a can in an oblique view at the beginning of tearing open.
Figure 2:
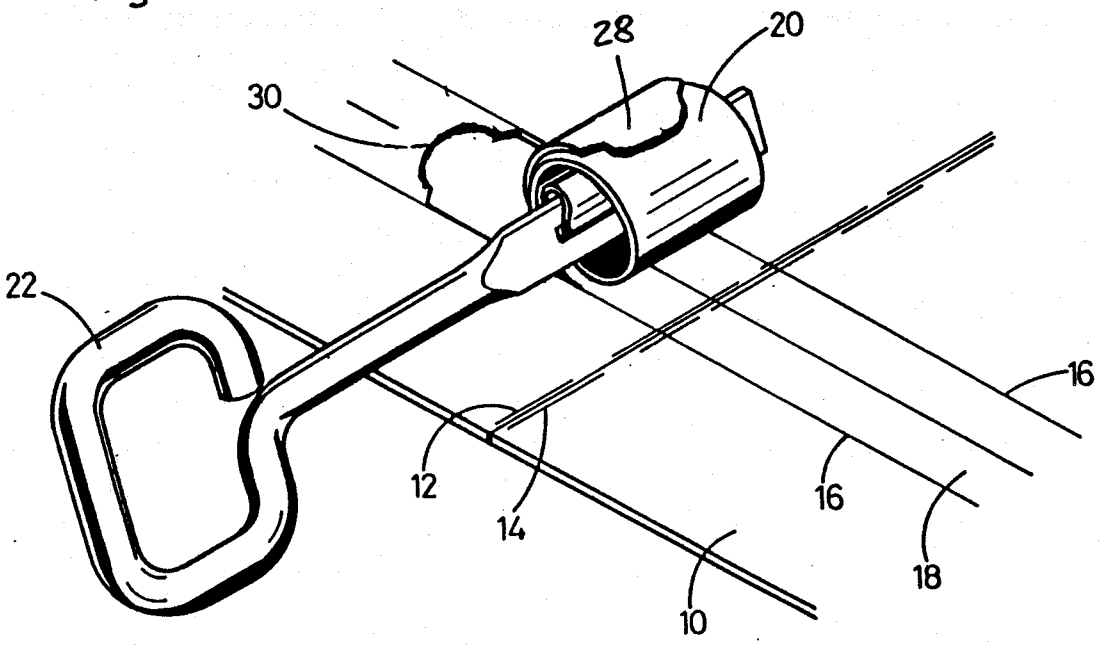
FIG. 2 shows an enlarged detail from FIG. 1.

The can member 10 illustrated is originally a rectangular sheet-metal blank with two longitudinal edges 12 and 14. In the course of production of a can, the can member 10 is rolled up to form a cylindrical body as indicated by a circle in FIG. 1. Then the two longitudinal edges 12 and 14 are welded together. The welding seam may be an overlapped mash seam or, as indicated in FIGS. 1 and 2, a butt seam which can be produced by laser welding.

The can member 10 has a pair of parallel scorings 16 which are impressed at right angles to the longitudinal edges 12 and 14 and define a tear-off strip 18 laterally, which extends over the whole circumference of the finished can. Welded onto the tear-off strip 18 is a tongue 20 on which a key 22 can be placed as shown in FIGS. 1 and 2, in order to roll up first the tongue 20 and then the whole tear-off strip 18. In the course of this, the key 22 rolls along one of the two beaded edges 24 which connect the parallelepiped can member shown in FIG. 1 to a cover and a bottom 26 respectively.

Figure 6:
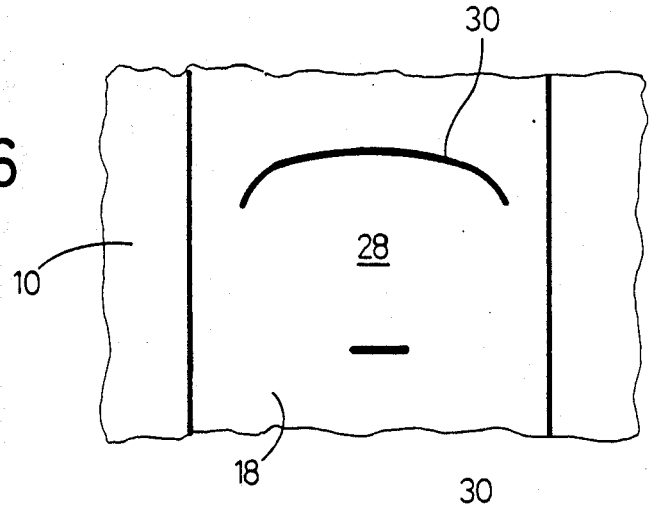

The tear-off strip 18 may comprise, between the two scorings 16 defining it laterally and parallel to these, one (FIGS. 1 to 3) or two (FIGS. 6 to 8) additional longitudinal scorings which likewise extend over the whole circumference of the can.

In the tear-off strip 18, a field 28 is defined by a starting scoring 30. The field 28 is disposed at a sufficient distance from the two longitudinal edges 12 and 14 to remain free from any structural change in the sheet-metal which occurs during the welding together of the two longitudinal edges. In the preferred examples illustrated, the width of the field 28 is about three quarters of the width of the tear-off strip 18. The starting scoring 30 can be produced with a press die, preferably when the can member 10 is in the plane state after the scorings 16 have been impressed.

According to FIGS. 1 to 5, the field 28 is oval and completely surrounded by the starting scoring 30; the centre of the field 28 is situated as accurately as possible midway between the two lateral scorings 16.

Figure 7:
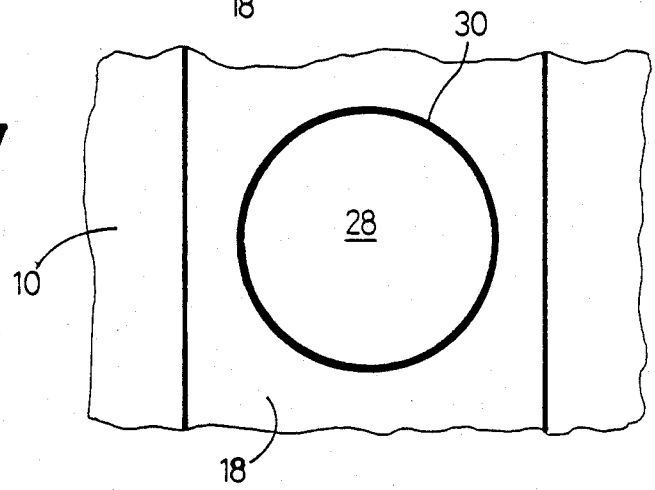
Figure 8:
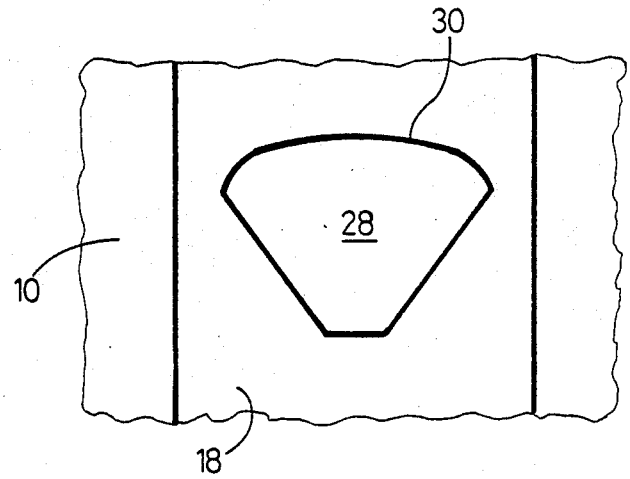

The field 28 may, however, also be defined by a starting scoring 30 of a different shape, particularly a circular or substantially trapezoidal starting scoring 30 as shown in FIG. 7 or 8. It is common to all the forms of embodiment illustrated that a central front portion of the starting scoring or a tangent drawn thereto extends at right angles to the lateral scorings 16 and that this central portion is followed by lateral portions of the starting scoring which extend towards the rear, preferably parallel to the lateral scorings 16.

Figure 4:
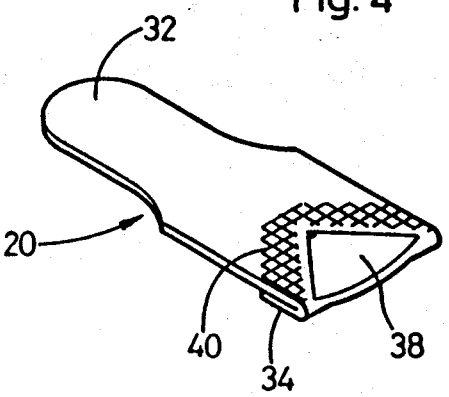
FIG. 4 shows the view of the tongue from below in the direction of the arrow IV in FIG. 3
Figure 3:
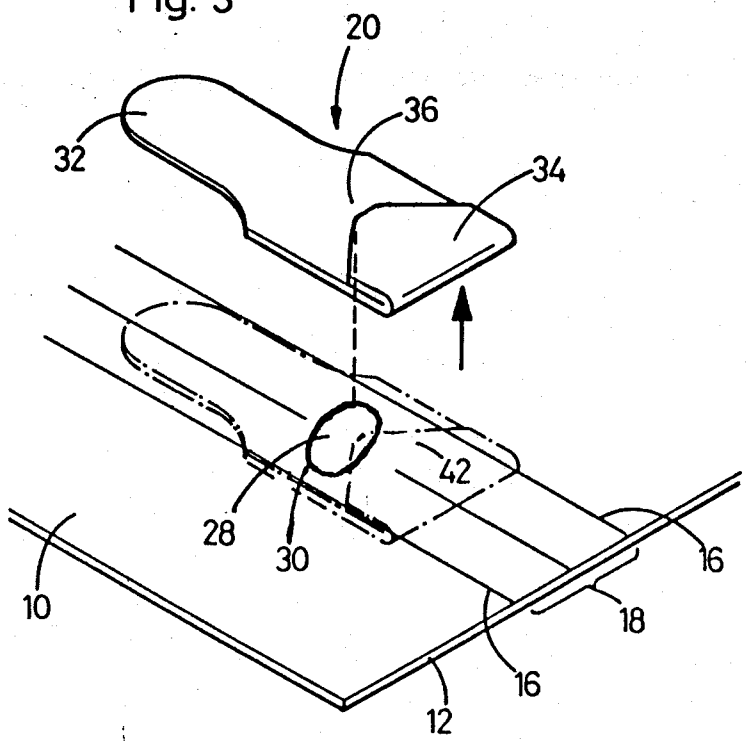
FIG. 3 shows a detail of a can member onto which a tongue is being welded.
Figure 5:
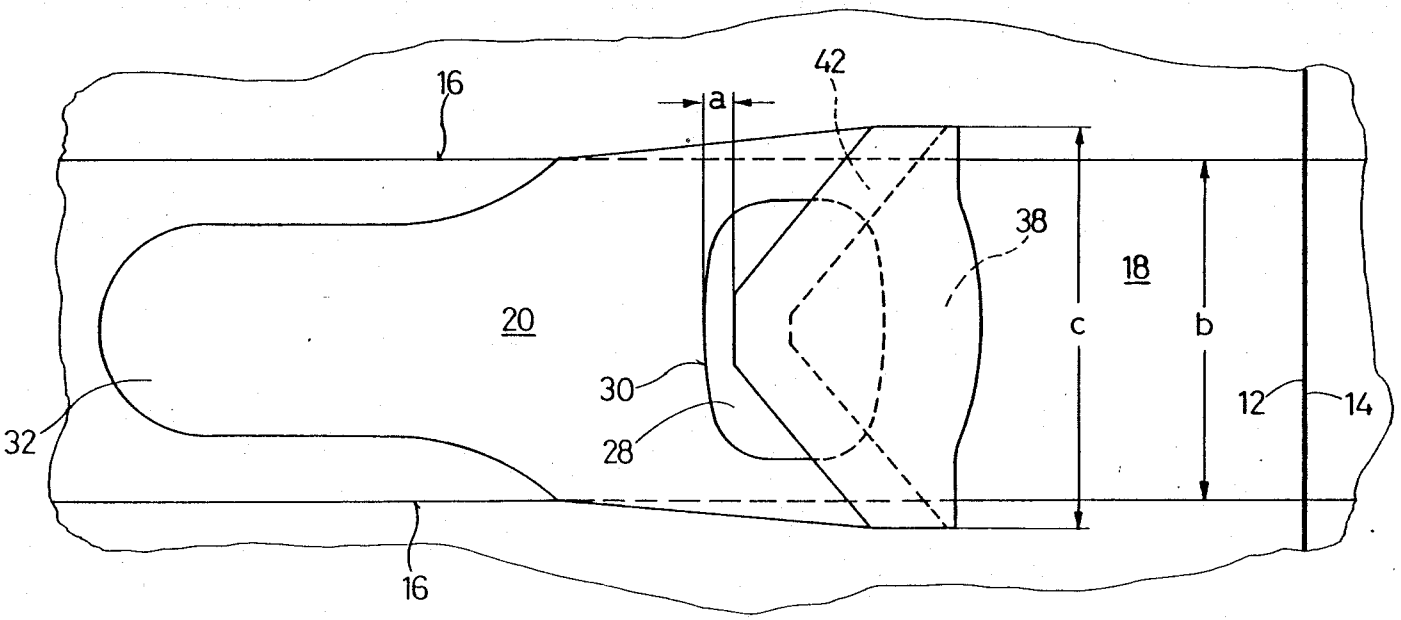
FIG. 5 shows an enlarged plan view of the can member with welded-on tongue and FIGS. 6–8 show various modifications of FIG. 5.

The tongue 20 has a free end 32 which is adapted for slipping on the key 22 and can be bent easily away from the can member 10 - for example with a finger nail. The other end of the tongue 20, which is welded to the can member 10, comprises a thickened portion 34 which, in the examples illustrated, has been formed as a result of the fact that an arrow-shaped end portion has been folded back outwards during the punching of the tongue 20 in such a manner that its end 36, which is somewhat blunted in FIGS. 3 to 5, is directed forwards towards the free end 32 of the tongue 20.

Impressed in the under side of the tongue 20 is a depression 38 which is likewise arrow-shaped and directed towards the free end 32 but is smaller than the thickened portion 34. The depression 38 is bounded, in the direction towards the free end 32 of the tongue 20, by a region 40 which is correspondingly arrow-shaped and has a honeycomb-like surface structure projecting slightly in relation to the rest of the under side of the tongue.

With each of the forms of the field 28 illustrated in FIGS. 5 to 8, the tongue 20 is arranged, when being welded onto the tear-off strip 18, so that its blunted end 36 has a spacing a of the order of magnitude of two to three times the thickness of the sheet-metal of the can member from the central front portion of the starting scoring 30. For example, with a thickness of the sheet-metal of the can member of 0.2, the spacing a=0.5 mm. The front end of the depression 38 lies over the middle of the field 28.

During the welding, a particularly satisfactory passage of current develops between the arrow-shaped region 40 with a honeycomb-like structure and the can member, under the influence of a pressure produced by welding electrodes, so that a welding region 42 results where the arrow-shaped region 40 covers the can member. Thus the welding region 42 is likewise substantially arrow-shaped; it extends over the field 28 and also slightly beyond the two scorings 16 defining the tear-off strip 18 laterally. With a width b of the tear-off strip 18 of 6.0 mm, the total width c of the welding region 42 may be 7 mm for example, so that the welding region extends beyond each of the two lateral scorings by 0.5 mm.

I claim:

1. A tear-open can member comprising:

a sheet-metal member having a pair of generally parallel scorings (16) which define a tear-off strip (18) therebetween, and a tongue (20) which is welded as a separate sheet-metal member to the tear-off strip (18) at one of its ends in a welding region (42) which extends substantially over the whole width (b) of the tear-off strip (18), the sheet-metal member also having a starting scoring (30) which extends over the tear-off strip (18) between the welding region (42) and the free end (32) of the tongue (20), and which extends substantially transversely to the parallel scorings (16) only in a central region of the tear-off strip (18) and away from the free end (32) of the tongue (20) in the vicinity of the parallel scorings (16), and the welding region (42) covers the starting scoring (30) in the vicinity of each of the two parallel scorings.

2. A can member as claimed in claim 1, characterised in that, over two thirds to four fifths of the width of the tear-off strip (18), the starting scoring (30) has the shape of an arc extending transversely and convex towards the free end (32) of the tongue (20).

3. A can member as claimed in claim 2, characterised in that, following on the arc at both sides, the starting scoring (30) extends substantially parallel to the parallel scorings (16).

4. A can member as claimed in claim 2, characterised in that the starting scoring (30) is circular.

5. A can member as claimed in claim 2, characterised in that the starting scoring (30) is oval.

6. A can member as claimed in claim 2, characterised in that, following on the arc at both sides, the starting scoring (30) is closed on itself in the form of a trapezoid.

7. A can member as claimed in claim 1, wherein the tongue (20) has, at its welded-on end, a thickened portion (34) determining the welding region (42) and/or prominent portions projecting towards the tear-off strip (18) in the form of an arrow directed towards the free end (32) of the tongue (20), characterised in that the front end (36) of the arrow-shaped thickened portion (34) or prominent portions is set back in relation to the starting scoring (30) by about two to three times the thickness of the sheet-metal of the can member.

* * * * *